US006468294B2

(12) United States Patent
Griffith

(10) Patent No.: US 6,468,294 B2
(45) Date of Patent: Oct. 22, 2002

(54) VIBRATING PACIFIER

(76) Inventor: Jonathan D. Griffith, 127 Ridgeway Dr., Greenville, SC (US) 29607

( * ) Notice: Subject to any disclaimer, the term of this patent is extended or adjusted under 35 U.S.C. 154(b) by 0 days.

(21) Appl. No.: 09/917,029

(22) Filed: Jul. 27, 2001

(65) Prior Publication Data

US 2001/0047189 A1 Nov. 29, 2001

Related U.S. Application Data

(63) Continuation of application No. 09/510,463, filed on Feb. 22, 2000.

(60) Provisional application No. 60/121,058, filed on Feb. 22, 1999.

(51) Int. Cl.[7] ..... A61J 17/00

(52) U.S. Cl. ..... 606/234; 601/67

(58) Field of Search ..... 606/234–236; 601/46, 67–69

(56) References Cited

U.S. PATENT DOCUMENTS 5,693,073 A * 12/1997 Glick et al. ..... 606/236
6,193,742 B1 * 2/2001 Moriarty ..... 606/234

* cited by examiner

*Primary Examiner*—Kennedy Schaetzle
*Assistant Examiner*—Kristen Droesch
(74) *Attorney, Agent, or Firm*—Joseph T. Guy; Nexsen Pruet Jacobs & Pollard, LLC

(57) ABSTRACT

A vibrating pacifier which includes a housing, a nipple, and a massaging unit having a power supply for causing the nipple to vibrate. The power supply in the massaging unit supplies power to a vibrating unit that causes the nipple of the pacifier to vibrate, thus massaging a child's gums. The vibrating unit also provides a humming noise that is soothing to the child.

3 Claims, 6 Drawing Sheets

VIBRATING PACIFIER

This application is a continuation and claims priority to U.S. patent application Ser. No. 09/510,463 filed Feb. 22, 2000, and claims the benefit of Provisional application No. 60/121,058, filed Feb. 22, 1999.

FIELD OF THE INVENTION

BACKGROUND OF THE INVENTION

1. Field of the Invention

The present invention relates to devices for soothing discomfort associated with teething and for helping children fall asleep more quickly. More particularly, the pacifier of the present invention gently massages a baby's gums while producing a low humming noise that helps calm a child.

2. Description of Related Art Including Information Disclosed Under 37 CFR 1.97 and 37 CFR 1.98

Teething rings and pacifiers are used to relieve some of the pain of teething by providing a soft material, usually rubber or silicon, for a child to chew on. More recently, some teething rings contain vibrating components which massage a child's gums. Though several of these vibrating devices exist, generally speaking these devices are ineffective, too heavy, fragile or unsafe, especially for very young infants.

U.S. Pat. No. 3,115,139 discloses a vibrating teething device. Although satisfactory in some respects, there are significant disadvantages associated with this device. The device is described as having a vibrating nipple member that is powered by one or more relatively large batteries. The large batteries render the device heavy and thus potentially dangerous to the infant. The device is further described as resembling a nursing bottle and so is relatively large and cumbersome and thereby likely difficult for a small infant to grasp. Furthermore, the device is susceptible to failure in view of the relatively high number of moving parts. Moreover, the design of the device described in the '139 patent is such that vibrations would travel, not only to the intended nipple member, but throughout the device. This is undesirable for at least two reasons. First, it is difficult for an infant to grasp, and particularly maintain a hold about, a vibrating outer cover. Second, allowing other regions and components of the device to vibrate besides the nipple member, expends additional energy other than that which is necessary and thus causes rapid battery drain.

U.S. Pat. No. 5,693,073 discloses a vibrating pacifier having a vibrating nipple. Because it produces a mere two dimensional oscillation, however, evenly distributed three dimensional vibrational energy is not produced. Thus, vibrational characteristics are not uniform around the circumference of the nipple, which is less calming to the child. In addition, what is described as a vibrating unit is contained within the housing making the housing heavy and difficult to use for infants. At the other end of the nipple is a hardened metallic coil. Because only a thin and relatively delicate spring tuning fork extends into the nipple, space between the relatively heavy nipple end and the heavy housing is mostly empty. This has at least two disadvantages. First, the relatively heavy housing end tends to pull the device out of a baby's mouth, so that the device constantly tips from side to side. Second, the hollow mid section is likely to be crushed, even with normal wear and tear.

Moreover, what is described as a semi-rigid coil cover encases the coil, oscillating spring, and delicate wiring connection from the coil. If the cover is pliable enough to activate the pressure sensitive internal switch therein described, it presents at least two disadvantages. First, the hardened coil and its mounting are likely to wear through the casing to harm a child. Second, if stepped on or subjected to other normal wear and tear, especially that wear which children subject to objects, the internal spring, magnet and coil will be crushed and certainly destroyed, masking the device useless. If, on the other hand, the casing is rigid enough to withstand such punishment, either the switch will not be activated, or the casing will comprise at least two pieces of material and thus a seem. Either way, the device is neither durable nor safe.

U.S. Pat. No. 5,683,421 discloses a teething ring having multiple switches for producing a vibrational force. The multiplicity of switches may be depressed simultaneously to cause several vibrational speeds depending on the extent and location of bitting pressure. As the number of parallel connections increase power is also increased, so that vibrational speeds randomly change, however, which tends to disturb, rather than calm a child. Moreover, the relatively large disk shape of the apparatus inhibits contact with rear portions of a child's gum line, and the soft silicon exterior, if worn through, exposes electric leads and other electro mechanical components which have the potential to harm a child.

U.S. Pat. No. 5,902,322 discloses a vibrating teething ring which transfers kinetic vibrational energy through several mechanical arms to the exterior ring. This, however, is not only inefficient, but also produces an uneven amount of vibration at various points along the circumference of the ring. Moreover, the relatively large disk shape of the apparatus inhibits contact with rear portions of a child's gum line.

U.S. Pat. No. 5,649,964 discloses a vibrating teething ring having a vibrating component in its handle, apart from the ring itself. It is designed to be disassembled and as such may be disassembled by a child to thus expose a child to internal electromechanical components and other small parts on which a child may choke.

U.S. Pat. No. 5,551,952 discloses a vibrating teething ring having bumps. It has an external switch, thus susceptible to exposure to external fluids such as a child's saliva. Plus, vibrational energy produced therefrom is not evenly distributed throughout the entire bitting surface. The relatively large disk shape of the apparatus inhibits contact with rear portions of a child's gum line, and the soft silicon exterior, if worn through, exposes electric leads and other electro mechanical components which have the potential to harm a child.

Clearly, there is room for improvement in the art.

BRIEF SUMMARY OF THE INVENTION

It is an object of the present invention, therefore, to provide a vibrating pacifier which reaches all portions of a child's gum line.

It is a further object of the present invention to provide a vibrating pacifier which supplies a direct and thus consistent source of vibrational kinetic energy which is evenly distributed along the circumference and three dimensional entirety of its mouth piece to enhance its calming effect.

It is a further object of the present invention to provide a more durable vibrating pacifier.

It is a further object of the present invention to provide a safer vibrating pacifier.

It is a further object of the present invention to provide a vibrating pacifier which is small and light enough for a very young infant to use and which does not need to be held during use.

These and other objects may be attained in the apparatus of the present invention which includes a housing, a nipple, and a massaging unit having a power supply for causing the nipple to vibrate. The power supply in the massaging unit supplies power to a vibrating unit that causes the nipple of the pacifier to vibrate, thus massaging a child's gums. Moreover, a number of tightly packed and concentrically disposed component layers provide both durability and an even, dampened, and circumferential distribution of vibrational messaging energy. The vibrating unit also provides a humming noise that is soothing to the child.

In particular, the nipple and massaging unit contained therein are shaped to reach the child's entire gum line and mouth. Second, the pacifier of the present invention supplies a direct and thus consistent source of vibrational kinetic energy which more effectively calms the child. Moreover, the pacifier of the present invention comprises compactly fitting component parts which lends durability and thus safety as well. The pacifier of the present invention features a number of other safety advantages including the absence of removable parts and the presence of a wear proof nipple, both of which completely protect a child from exposure to internal electromechanical component parts. In addition, the pacifier of the present invention is small and light enough for a very young infant to use, in part because it does not need to be held during use. More importantly, the pacifier of the present invention is weighted to remain within a child's mouth without tipping over and out of the mouth.

DESCRIPTION OF THE PREFERRED EMBODIMENTS

Figure 1:
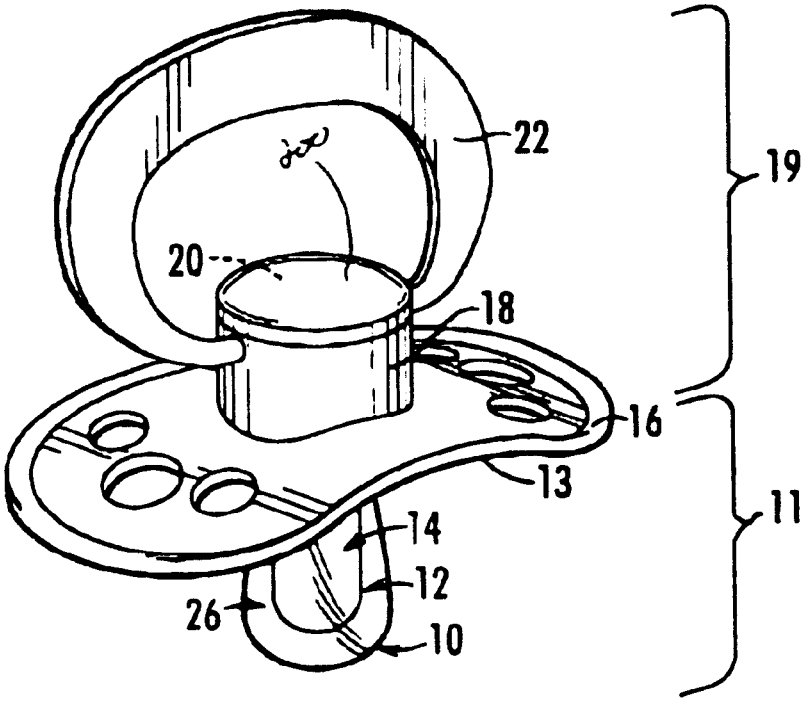
FIG. 1 is a side sectional view of a pacifier in accordance with the present invention.

The pacifier of the present invention may comprise a section which includes a hinged ring, a power supply, and housing for the power supply. A traditionally rigid shield separates the nipple section from the ring section, and has holes to allow air to pass, reduce weight, and increase comfort. The nipple section of the pacifier of this invention includes a soft, wear resistant and protective nipple, a massaging unit, a housing for the massaging unit and a micro switch.

More importantly, the nipple section comprises a number of tightly packed and concentrically disposed component layers which provide durability, safety, and an even, dampened, circumferential distribution of vibrational messaging energy. In addition, the pacifier of the present invention provides a vibrating nipple which reaches all portions of a child's gum line and which directly applies a consistent source of vibrational kinetic energy. What is more, the pacifier of the present invention is small and light enough for a very young infant to use because hand holding of the apparatus is not required.

A number of concentrically spaced and tightly fitting layers provide a unique and surprisingly effective supply of vibrational energy. As vibrational kinetic energy radiates from a rigid massaging unit housing, and then through a number of conductive, and nonconductive material layers, preferably disposed in alternating layered fashion, the sharpness of the vibrations is dampened so as to produce a surprisingly pleasing massage to a child's gums.

Because the massaging unit which produces vibration is contained within the nipple, a direct source of vibrational kinetic energy is available along the length and circumference of the tubular, and preferably substantially cylindrical, and thus narrow nipple shape. Vibrational energy transfer through a mechanical arm, therefore, is not required. This affords a direct and thus more mechanically efficient and even vibrational massage. This resulting consistency more effectively calms a child by excluding random variations in vibrational speed which tend to upset a child.

The pacifier of the present invention is extremely durable. Because component parts compactly and tightly fit within the sealed housing, there exists almost no unused space. As such, component parts are less likely to shift in relation to one another, thereby becoming misshaped, bent or deformed. Plus, the massaging unit is contained at the very center of the nipple within a special rigid casing. As a result, pacifiers in accord with the present invention may be thrown, dropped, stepped on and so forth, without diminishing their vibrating effectiveness.

The pacifier of the present invention is also extremely safe in at least two respects. First, it is extremely difficult to disassemble. For example, the pacifier of the present invention has no removable component parts on which a child could choke. Thus, under normal or even destructive conditions neither chemical, electronic nor mechanical elements of the pacifier of the present invention will become exposed so as to present a threat to the child.

More specifically, the base portions of the various concentrically disposed components of the nipple and massaging unit provide at least two important safety features. First, several of the base portions of these components exist as single piece cylinders or closed tubes having form fitting base portions. These base portions, especially when pressed together in layered fashion, hold the nipple, micro switch and massaging unit firmly attached to the pacifier housing. This is achieved without fastening devices or any type of glue. Thus, cylindrical portions of the various components fit concentrically within one another, and are fit through a hole in the housing for the power supply. The layered base portions each act as stoppers which make sure the components cannot be pulled completely through and out of the hole, so as to detach any component, i.e. the nipple or massaging unit contained therein.

Second, components, including the nipple base portion, and various massaging unit base portions and power source, compactly fit within the power source housing to provide a relatively tight fit. Resulting pressure on the base portion layers provides additional securing of these components which precludes the possibility of a child ever disassembling the device or otherwise becoming exposed to internal component parts.

A second safety feature of the present invention is a wear proof nipple. It comprises a metallic nipple barrier which form fits just within the soft exterior nipple. Therefore, even if the outer soft nipple layer becomes worn through, a child will never become exposed to internal electromechanical vibration producing components. Thus, this metallic layer which is preferably made from aluminum or brass, provides a foolproof protective barrier that is safe for the child to chew on. Because current flows exclusively through the interior side of the cylindrical exterior lead, moreover, a child who touches the exterior surface of the metallic conductive nipple will not be exposed to electrical current flow. Current does not flow outside the switch also because only one side of the circuit is exposed.

The pacifier of the present invention, because of its compact design does not require that it be hand held. Like other small, conventional non-vibrating nipple-shaped pacifiers, the present invention can be adapted to be light enough that it need only be placed within a small infant's mouth. As such, even a very young child who is incapable or unwilling to hold a pacifier, for example while sleeping, can use a pacifier in accordance with the present invention.

These advantages are achieved in part by a unique micro switch comprising a flexible and resilient external lead having a substantially tubular shape and an external wall; an insulator having a substantially tubular shape and being in communication with the external lead; and an internal lead having a substantially tubular shape and being in communication with the insulator. The insulator moreover, is disposed concentric to and at least partially within the external lead. Likewise, the internal lead is disposed concentric to and partially within the insulator.

The external lead and the internal lead have ends which are concentrically spaced by the insulator. These ends may be momentarily connected by applying a pressure to the exterior wall of the external lead, thereby closing the switch. Because the external lead is flexible and resilient, the ends may be disconnected by releasing this pressure, thereby opening the switch. It should be noted that in a preferred embodiment, the internal lead, the external lead, and the insulator are cylindrically shaped.

Apparatus

Figure 2:
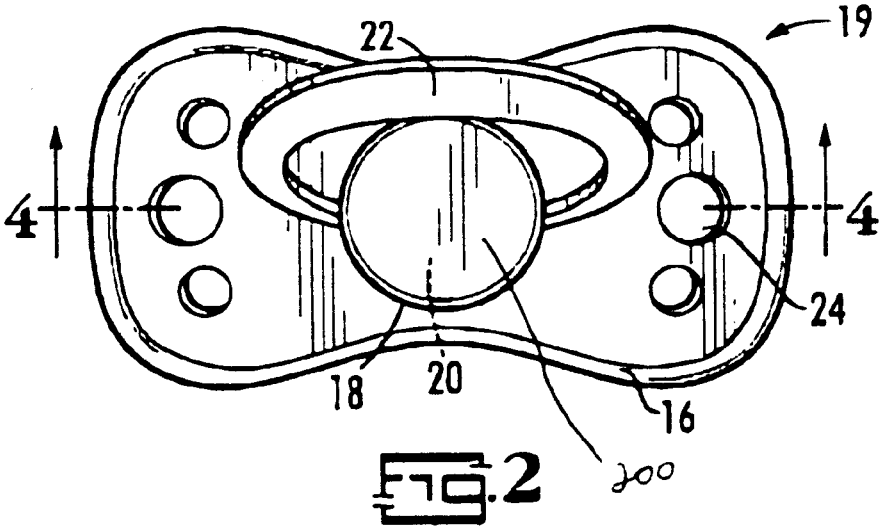
FIG. 2 is a rear sectional view of the pacifier of FIG. 1.

In a preferred embodiment, and as seen in FIGS. 1 and 2, one apparatus in accord with the present invention comprises ring section 19 which includes a hinged ring 22, a power supply 20, and housing for the power supply 18. The traditionally rigid shield 16 separates the nipple section from the ring section, and has holes 24 to allow air to pass, reduce weight, and increase comfort. The nipple section 11 of the pacifier of this embodiment includes a soft nipple 10, a massaging unit 14, a housing for the massaging unit 12, and a micro switch 26. This embodiment is ideally suited for infants aged from about 0 months to about 3 months and weighs less than about 17 grams.

The housing for the power supply 18 and a rear cover 200 exist to enclose the power supply 20. It is envisioned that a wide array of attachment configurations may be utilized to engage the rear cover and the power source housing to each other, including but not limited to forms of snap-fit configurations, conventional threaded fasteners, sonic welding, hook and loop materials known as VELCRO®, and adhesives either alone or in any combination with the foregoing. Regardless of the attachment configuration selected, a seal that prevents the introduction of water into the interior of the pacifier should be provided.

The front face 13 of power supply housing 18 defines a hole 15 through which nipple section 11 component parts fit. Although the aperture is preferably circular, such shape is not required. Other configurations are included within the present invention such as, but not limited to, slotted openings, oval, rectangular, and square-shaped apertures.

Figure 3:
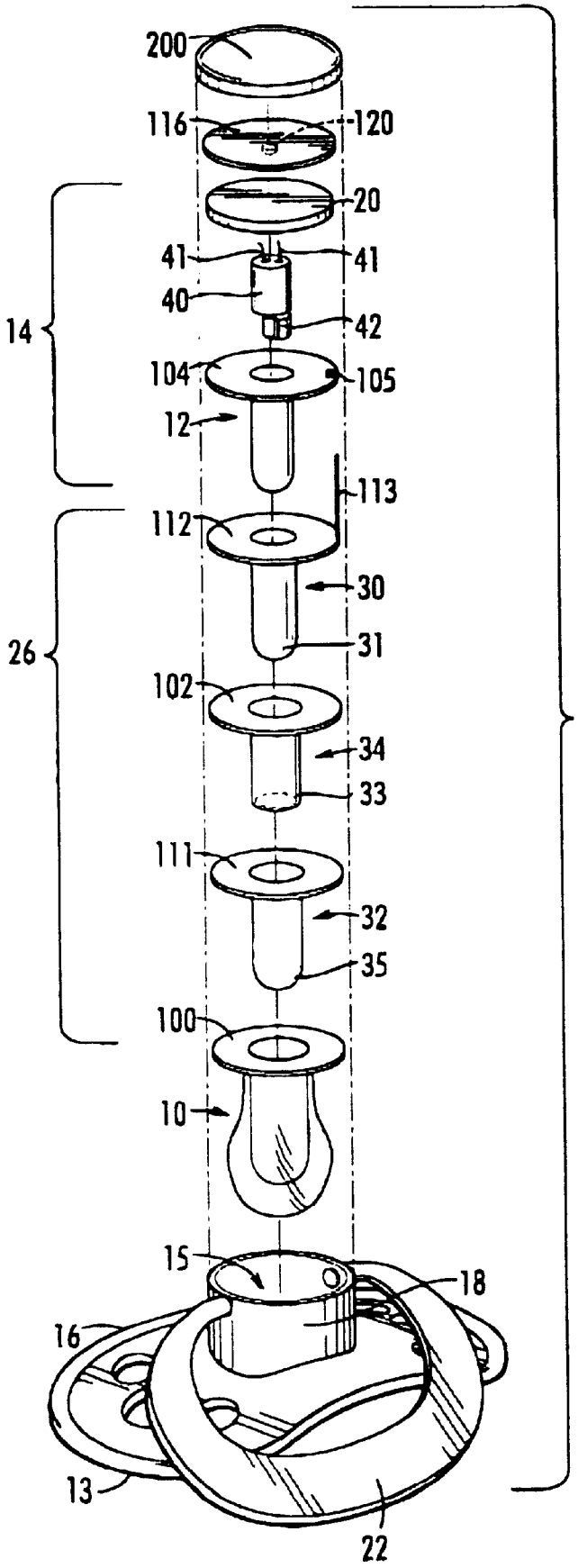
FIG. 3 is a perspective, exploded view of the pacifier of FIG. 1, in accordance with the present invention.

Several concentrically disposed components form the nipple section 11 and internal portion of the housing 18. Referring to FIG. 3, the outside of the nipple section 11 is a soft nipple 10 preferably made from silicon and having a base portion 100. Within and on top of this fits exterior conductive plate 32 which serves as an exterior lead for micro switch 26. It is of single piece design and has a base portion 111. Connected thereto is a small electric motor 40 coupled with an offset 42, preferably a 1.5 volt motor which may be obtained from the Namiki Corporation, via one of connections 41. The other motor lead 41 is connected to power source 20, which is preferably a 1.5 volt button battery. Plastic insulator 34, preferably made of hard polyethylene, fits within exterior conductive plate 32 and has a base portion 102 which when assembled lays on top of base portion 111 of conductive plate 32. Concentrically fit within and through plastic insulator 34 is interior conductive plate 30 which serves as an interior lead for micro switch 26. Thus, plastic insulator 34 and its base portion 102 separate and insulate interior conductive plate 30 from exterior conductive plate 32.

A plastic motor case, preferably made from rigid polyethylene plastic, acts as massaging unit housing 12. It fits concentrically within and layered on top of interior conductive plate 30 and has a base portion 104. Within base portion 104 is a notch 105 through which extends conductive lead 113, which is preferably made from a conductive metal and attached to base portion 112 and folds over base portion 104 to connect to the underside of power source 20, that is between base portion 104 and power source 20. Massaging unit 14, preferably includes a massaging unit housing 12, power source 20, and a vibrating unit which is preferably an electric motor 40 coupled with an offset 42, preferably a 1.5 volt motor which may be obtained from the Namiki Corporation, both of which fit within housing 12. Massaging unit 14 fits partially within, and layered on top of, interior conductive plate 30. It is important to note, moreover, that motor 40 is completely contained within nipple section 11. Top conductive plate 116 having dimple 120 rests above base portion 104 of massaging unit housing 12 and is preferably made from a conductive metal or alloy, i.e. brass, aluminum, and/or steel. It thus couples power source 20 to electric motor 40. Finally, lid 200, preferably made from plastic, fits on top of the above layers, to irremovably close the housing and produce a compact and tight fit.

Figure 4:
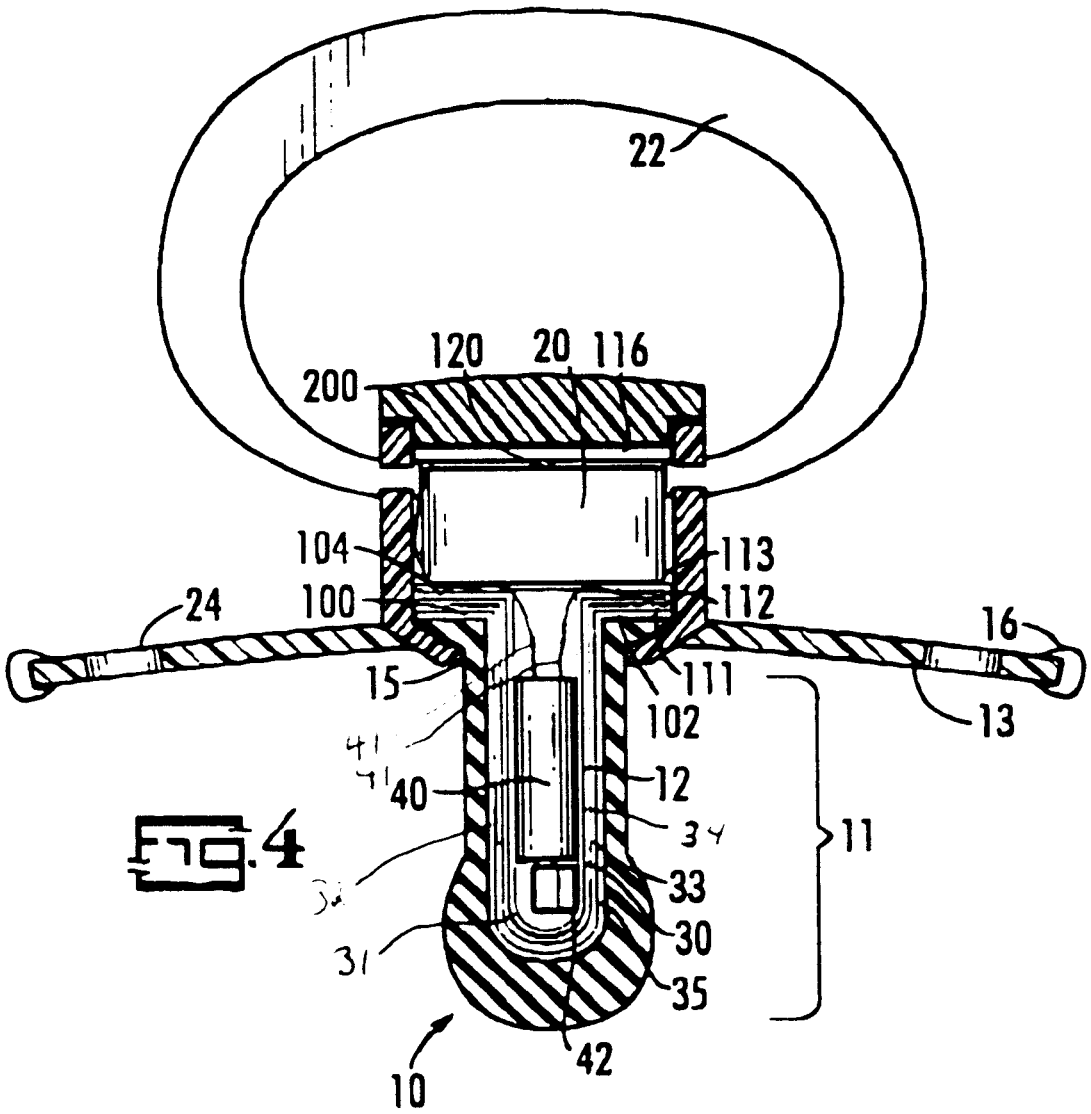
FIG. 4 is a cross sectional view of the pacifier of FIG. 1, in accordance with the present invention.

Referring to FIG. 4, it should be noted that space directly between the tip 31 of interior conductive plate 30 and tip 35 of exterior conductive plate 32 is not occupied by plastic insulator 34 beyond the end 33 of plastic insulator 34, because tip 31 protrudes through end 33. While the plastic insulator normally serves to preserve the space between interior conductive plate tip 31 and exterior conductive plate tip 35, as external pressure is applied to soft nipple 10 and thus, nipple section 11, exterior conductive plate tip 35 concentrically closes this space to touch interior conductive plate tip 31, thereby closing micro switch 26. Once external pressure is released, i.e. when a child ceases to bite, chew or suck, the exterior conductive plate tip 35 resiliently returns to its original position—that is, in completely and concentrically spaced apart relation to interior conductive plate tip 31, thereby opening micro switch 26.

When the switch is closed, current runs either forward or reverse along the following path, depending on power source polarity. Beginning at tip 35 of exterior conductive plate 32, current may flow to base portion 111, then motor 40, then conductive plate 116, then power source 20, to to conductive lead 113, to base portion 112 of interior conductive plate 30, and back to tip 35 of exterior conductive plate 32 via interior conductive plate tip 31, to complete the circuit. In an alternate preferred embodiment, current runs in the opposite direction along this same path. It should also be noted that all conductive leads, base portions, and other conductive materials are preferably made from conductive metals and/or alloys such as but not limited to aluminum, brass, and steel.

Figure 5:
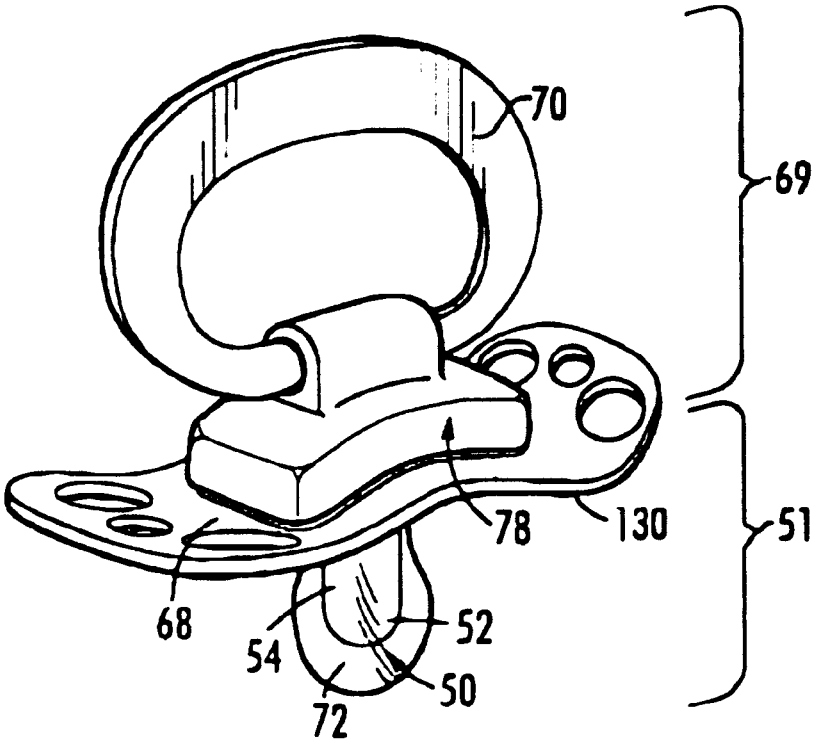
FIG. 5 is a side sectional view of another embodiment of a pacifier in accordance with the present invention.
Figure 6:
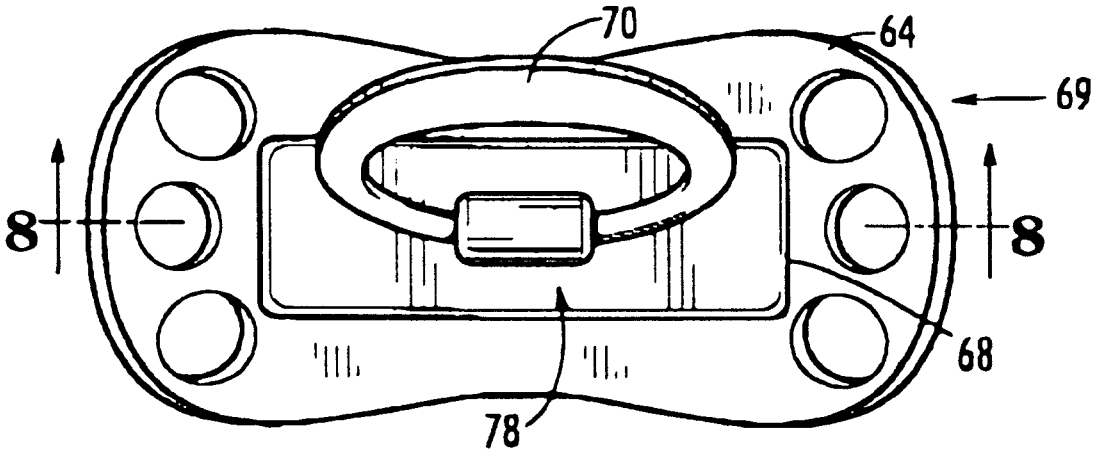
FIG. 6 is a rear sectional view of the pacifier of FIG. 5, in accordance with the present invention.

In a another preferred embodiment, and as seen in FIGS. 5 and 6, one apparatus in accord with the present invention comprises ring section 69 which includes a hinged ring 70, a power supply 78, and housing for the power supply 68. The traditionally rigid shield 64 separates the nipple section from the ring section. The nipple section 51 of the pacifier of this embodiment includes a soft nipple 50, a massaging unit 54, a housing for the massaging unit 52, and a micro switch 72. This embodiment is ideally suited for children aged from about 3 months and older, and weighs less than about 24 grams.

The housing 68 for the power supply and a rear cover 150 exist to enclose the power supply 78. It is envisioned that a wide array of attachment configurations may be utilized to engage the rear cover and the power source housing to each other, including but not limited to forms of snap-fit configurations, conventional threaded fasteners, sonic welding, hook and loop materials known as VELCRO®, and adhesives either alone or in any combination with the foregoing. Regardless of the attachment configuration selected, a seal that prevents the introduction of water into the interior of the pacifier should be provided.

The front face 130 of power supply housing 68 defines a hole 132 through which nipple section 51 component parts fit. Although the aperture is preferably circular, such shape is not required. Other configurations are included within the present invention such as, but not limited to, slotted openings, oval, rectangular, and square-shaped apertures.

Figure 7:
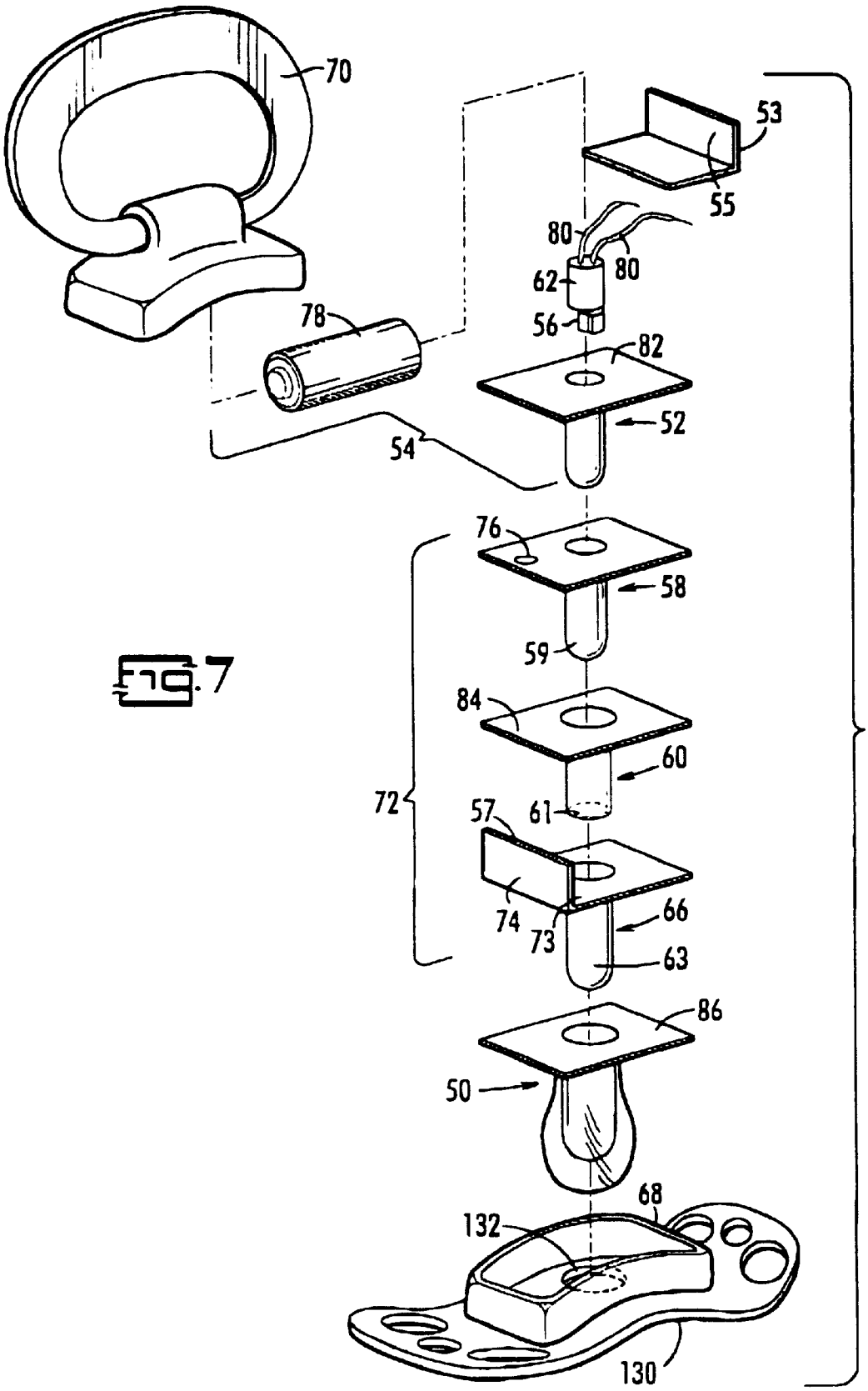
FIG. 7 is a perspective, exploded view of the pacifier of FIG. 5, in accordance with the present invention.

Several concentrically disposed components form the nipple section 51 and internal portion of the housing 68. Referring to FIG. 7, the outside of the nipple section 51 is a soft nipple 50 preferably made from silicon and having a base portion 86. Within and on top of this fits exterior conductive plate 66 which serves as an exterior lead for micro switch 72. It is of single piece design and has a base portion 73. Connected thereto is lead extension 74, preferably made from brass, and which is disposed perpendicular to base portion 73. Lead extension 74 has a dimple 57 for receiving one end of power source 78. Power source 78 is preferably an "N"-sized battery. Plastic insulator 60, preferably made of hard polyethylene, fits within exterior conductive plate 66 and has a base portion 84 which when assembled lays on top of base portion 73 of conductive plate 66. Concentrically fit within and through plastic insulator 60 is interior conductive plate 58, which serves as an internal lead for micro switch 72. Thus, plastic insulator 60 and its base portion 84 separate and insulate interior conductive plate 66 from exterior conductive plate 58.

A plastic motor case, preferably made from hard polyethylene plastic, acts as massaging unit housing 52. It fits concentrically within and layered on top of interior conductive plate 58 and has a base portion 82. Massaging unit 54 preferably includes a massaging unit housing 52, a power source 78 and a vibrating unit which is preferably an electric motor 62, preferably a 1.5 volt motor which may be obtained from the Namiki Corporation, coupled to an offset 56, all of which fits within housing 52. Massaging unit 54 fits within, and layered on top of, interior conductive plate 58. It is important to note, moreover, that motor 62 is completely contained within nipple section 51. Top conductive plate 53 rests above base portion 82 of massaging unit housing 52 and is preferably made from brass. It is couples power source 78 to electric motor 62.

Figure 8:
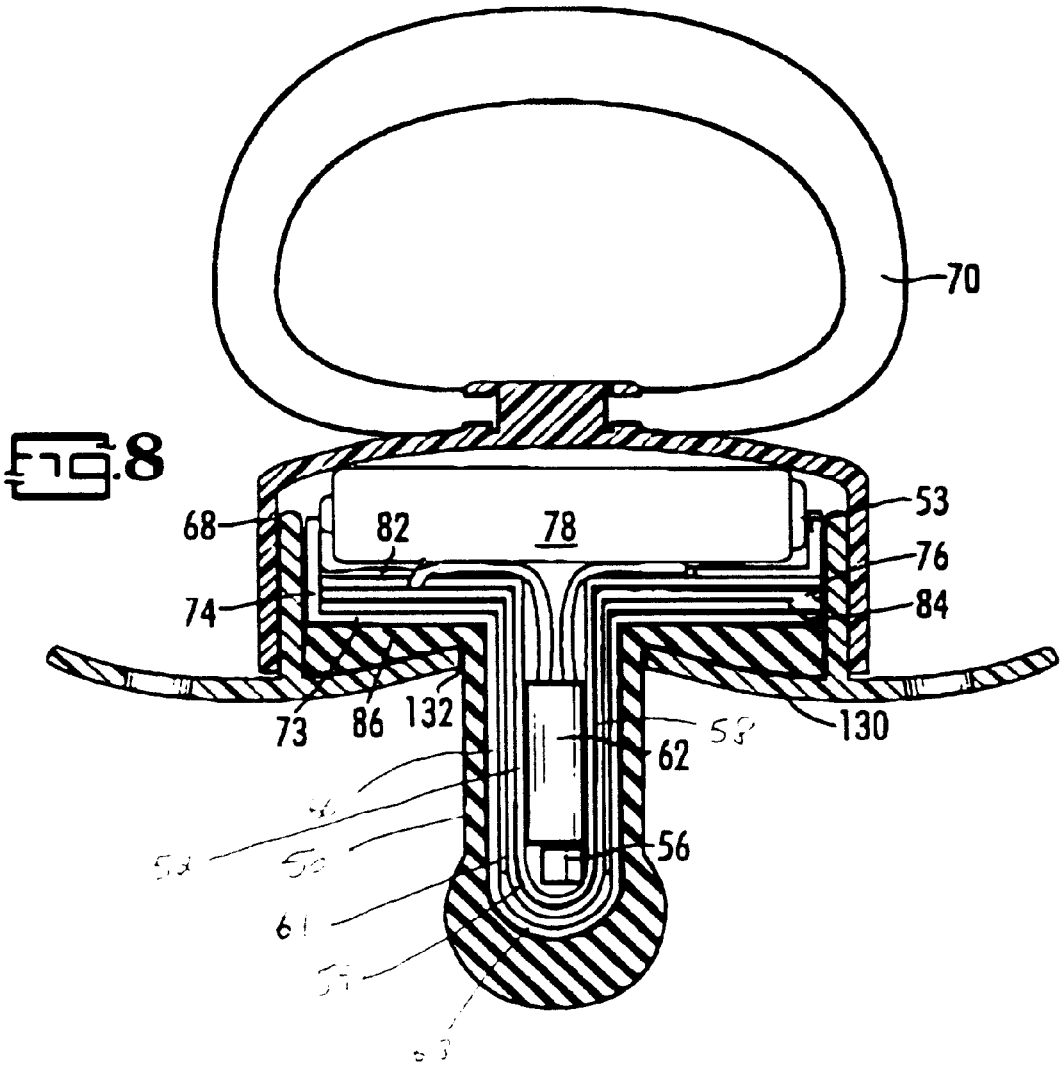
FIG. 8 is a cross sectional view of the pacifier of FIG. 5, in accordance with the present invention.

Referring to FIG. 8, it should be noted that space directly between the tip 59 of interior conductive plate 58 and tip 63 of exterior conductive plate 66 is not occupied by plastic insulator 60 beyond the end 61 of plastic insulator 60, because tip 59 protrudes through end 61. While the plastic insulator normally serves to preserve the space between interior conductive plate tip 59 and exterior conductive plate tip 63, as external pressure is applied to soft nipple 50 and thus, nipple section 51 seen in FIG. 5, exterior conductive plate tip 63 seen in FIG. 7, concentrically closes this space to touch interior conductive plate tip 59, thereby closing micro switch 72. Once external pressure is released, i.e. when a child ceases to bite, chew or suck, the exterior conductive plate tip 63 resiliently returns to its original position—that is, in completely and concentrically spaced-apart relation to interior conductive plate tip 59, thereby opening micro switch 72.

When the switch is closed, current runs either forward or reverse along the following path, depending on power source polarity. Beginning at tip 63 of exterior conductive plate 66, current may flow to base portion 73, then lead extension 74, then power source 78, to conductive plate 53 having a dimple 55, to electric motor 62, to base portion 76 of interior conductive plate 58, and back to tip 63 of exterior conductive plate 66 via interior conductive plate tip 59, to complete the circuit. In an alternate preferred embodiment, current runs in the opposite direction along this same path.

As seen, the present invention provides an apparatus for pacifying children. The apparatus includes a housing, a nipple, and a massaging unit having a power supply for causing the nipple to vibrate.

In accordance with the present invention, therefore, the power supply in the massaging unit supplies power to a vibrating unit that causes the nipple of the pacifier to vibrate, thus massaging a child's gums. The vibrating unit also provides a humming noise that is soothing to the child. Moreover, the nipple and massaging unit partially contained therein are shaped to reach the child's entire gum line and mouth. The pacifier of the present invention also supplies a direct and circumferentially evenly distributed source of vibrational kinetic energy, which more effectively calms the child and features a number of safety advantages including the absence of removable parts and the presence of a wear proof nipple, both of which completely protect a child from exposure to internal electromechanical component parts. The pacifier of the present invention is small and light enough for a very young infant to use in part because it does not need to be held during use, and is weighted in the nipple section so as to remain in the child's mouth. It will be evident to one skilled in the art that other objects are met by the foregoing invention.

It will be understood that various details of the invention may be changed without departing from the scope of the invention. Furthermore, the foregoing section description is for the purpose of illustration only, and not for the purpose of limitation since the invention is defined by the claims.

I claim:

1. A pacifier comprising:

a housing (18) having attached thereto a ring, a shield portion and a flexible nipple portion, wherein said housing contains a power supply (20) and wherein said nipple portion comprises an outer nipple; a pressure switch comprising a first electrical conductive plate interior to and concentric with said outer nipple, an insulator interior to and concentric with said first electrical conductive plate wherein said insulator comprises an end and a second electrical conductive plate interior to and concentric with said insulator wherein said second electrical conductive plate protrudes through said end, and contacts said first electrical conductive plate when pressure is applied to said outer nipple; and a rotating motor driving an offset unbalanced weight and said pressure switch activates said motor.

2. The pacifier according to claim 1 wherein said nipple contains at least three tightly packed and concentrically disposed component layers.

3. A pacifier comprising:

a housing (18) having attached thereto a ring, a shield portion and a flexible nipple portion, wherein said housing contains a power supply (20) and wherein said nipple portion comprises an outer nipple; a pressure switch comprising a first electrical conductive plate interior to and concentric with said outer nipple, an insulator interior to and concentric with said first electrical conductive plate wherein said insulator comprises an end and a second electrical conductive plate interior to and concentric with said insulator wherein said second electrical conductive plate protrudes through said end, and contacts said first electrical conductive plate when pressure is applied to said outer nipple; and a rotating motor driving an offset unbalanced weight and said pressure switch activates said motor wherein said switch comprises a flexible and resilient external lead having a substantially tubular shape and an external wall; an insulator having a substantially tubular shape and being in communication with said external lead, said insulator disposed concentric to and at least partially within said external lead; and an internal lead having a substantially tubular shape and being in communication with said insulator, said internal lead disposed concentric to and partially within said insulator; wherein said external lead and said internal lead have ends which are concentrically spaced by said insulator, wherein said ends may be connected by applying a pressure to said exterior wall of said external lead thereby closing said switch, and wherein said ends may be disconnected by releasing said pressure thereby opening said switch.

* * * * *